US007797780B2

(12) United States Patent
Hui et al.

(10) Patent No.: US 7,797,780 B2
(45) Date of Patent: Sep. 21, 2010

(54) WHEEL ARRANGEMENT FOR SWIMMING POOL CLEANER

(75) Inventors: Joseph Hui, Lakewood, NJ (US); Richard Holstein, Lakewood, NJ (US)

(73) Assignee: Smartpool, Inc., Lakewood, NJ (US)

( * ) Notice: Subject to any disclaimer, the term of this patent is extended or adjusted under 35 U.S.C. 154(b) by 1263 days.

(21) Appl. No.: 11/269,826

(22) Filed: Nov. 9, 2005

(65) Prior Publication Data

US 2006/0101596 A1 May 18, 2006

Related U.S. Application Data

(60) Provisional application No. 60/626,879, filed on Nov. 12, 2004.

(51) Int. Cl.
*E04H 4/16* (2006.01)

(52) U.S. Cl. ..... 15/1.7

(58) Field of Classification Search ..... 15/1.7; 280/89.11

See application file for complete search history.

(56) References Cited

U.S. PATENT DOCUMENTS

| | | | | |
|---|---|---|---|---|
| 659,078 | A * | 10/1900 | Lieb | 180/277 |
| 1,328,681 | A * | 1/1920 | MacDonald | 280/89.11 |
| 1,342,507 | A * | 6/1920 | Mcnamara | 280/503 |
| 2,146,021 | A | 2/1939 | Lohr et al. | |
| 2,683,956 | A | 7/1954 | Conte | |
| 2,988,762 | A | 6/1961 | Babcock | |
| 4,029,164 | A * | 6/1977 | Urakami | 180/164 |
| 4,463,520 | A | 8/1984 | Crosman | |
| 4,920,599 | A | 5/1990 | Rief | |
| 5,454,129 | A | 10/1995 | Kell | |
| 5,956,626 | A * | 9/1999 | Kaschke et al. | 455/115.1 |
| 5,974,347 | A | 10/1999 | Nelson | |
| 6,412,133 | B1 | 7/2002 | Erlich et al. | |
| 6,742,613 | B2 | 6/2004 | Erlich et al. | |
| 2003/0159723 | A1 | 8/2003 | Hui | |

FOREIGN PATENT DOCUMENTS

| | | |
|---|---|---|
| EP | 1 022 411 A2 | 7/2000 |
| JP | 54-009457 | 1/1979 |
| JP | 54-050157 A | 4/1979 |
| JP | 54-003376 A | 11/1979 |

* cited by examiner

*Primary Examiner*—David B Thomas
(74) *Attorney, Agent, or Firm*—Birch, Stewart, Kolasch & Birch, LLP

(57) ABSTRACT

A pool cleaner for cleaning a pool includes a housing with an upper surface and downwardly projecting sidewalls extending from the upper surface for defining a front, a rear, a first and a second side of the housing. A first pair of wheels includes a first wheel being pivotally mounted relative to the first side of the housing and a second wheel being pivotally mounted relative to the second side of the housing. A tie rod is operatively mounted relative to the first wheel and the second wheel. A second pair of wheels is mounted on the rear end of the housing. As the pool cleaner traverses a pool surface and the first or second wheel is moved to be at a predetermined angular relationship relative to the housing, the tie rod ensures that the first and second wheels are at substantially the same angular relationship relative to the housing.

18 Claims, 4 Drawing Sheets

WHEEL ARRANGEMENT FOR SWIMMING POOL CLEANER

CROSS-REFERENCE TO RELATED APPLICATIONS

The present application claims priority under 35 USC 119 (e) to U.S. Provisional Patent Application No. 60/626,879 filed on Nov. 12, 2004 the entire contents of which are hereby incorporated by reference.

BACKGROUND OF THE INVENTION

1. Field of the Invention

The present invention is directed to the arrangement for the wheels of a pool cleaner wherein when a first or a second wheel is imparted with a predetermined angular relationship relative to a housing for the pool cleaner, a tie rod ensures that the first and second wheels will have substantially the same angular relationship relative to the housing.

2. Description of Background Art

A pool cleaner should be designed to traverse a pool whereby the entire bottom surface of the pool is cleaned. Hithertofor, a laterally offset fixed bumper element was provided on both ends of a pool cleaner to contact a sidewall of the pool and thereafter pivot the pool cleaner to assume a different trajectory when the motor for the pool cleaner is reversed. Thus, as the pool cleaner traverses the bottom of the pool, the bumper element will engage a sidewall of the pool and the angular relationship of the pool cleaner relative to the pool sidewall will be changed so that the pool cleaner will assume a different trajectory as it reverses direction.

In addition, pool cleaners are available that employ three wheels wherein one of the wheels is mounted on an axle that determines the direction of trajectory of the pool cleaner. The third wheel is mounted separately from the pair of wheels that support the pool cleaner for permitting a free-wheeling of the third wheel for enabling the pool cleaner to change directions.

If a pool cleaner is constructed with a single wheel that is pivoted relative to the pool cleaner housing, as the single pivoted wheel engages a wall surface of the pool, the pool cleaner will tend to move at an angle away from the longitudinal axis as it causes extra drag and tends to guide the unit to move at an angle to its longitudinal axis while the other non-pivotal wheels tend to make the unit travel along the longitudinal axis. This causes the unit to be unstable and move in an initial arc and then finally straighten our as long as all four wheels have the same friction between the wheels and the surface of the pool.

If a pool cleaner is constructed with two front wheels that are pivoted relative to the pool cleaner housing, as the left wheel swings to the left the right wheel swings to the right. When this happens, both wheels that are at opposing angles relative to the housing for the pool cleaner will create an equal and opposite drag that will result in a balanced and therefore a stable reversing motion which is undesirable for swimming pool cleaners.

SUMMARY AND OBJECTS OF THE INVENTION

It is one object of the present invention to provide a pool cleaner wherein the front wheels may be turned in tandem to an angular relationship relative to a housing for the pool cleaner by contact with the pool wall or other factors within the pool environment.

Another object of the present invention is to provide a first random timing mechanism that will delay the reversing of a drive mechanism for the pool cleaner as one of the front wheels engages a wall surface of a pool.

A further object of the present invention is to provide a second random timing mechanism wherein the direction of movement of the pool cleaner will be periodically changed throughout a cleaning cycle of the pool.

These and other objects of the present invention are achieved by providing a pool cleaner for cleaning a pool that includes a housing with an upper surface and downwardly projecting sidewalls extending from the upper surface for defining a front end, a rear end, a first side and a second side of the housing. A first pair of wheels is mounted relative to the front end of the housing. The first pair of wheels includes a first wheel being pivotally mounted relative to the first side of the housing and a second wheel being pivotally mounted relative to the second side of the housing. A tie rod is operatively mounted relative to the first wheel and the second wheel for ensuring substantially the same angular relationship of the first wheel and the second wheel relative to the housing. A second pair of wheels are mounted relative to the rear end of the housing. When the pool cleaner traverses a pool surface and the first wheel is moved to be at a predetermined angular relationship relative to the housing, the tie rod imparts movement to the second wheel for ensuring that the first and second wheels are at substantially the same angular relationship relative to the housing. However, the directional wheels are not locked into a fixed longitudinal angle or a fixed lateral position relative to the housing nor do the directional wheels move in a longitudinal axis relative to the cleaner body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
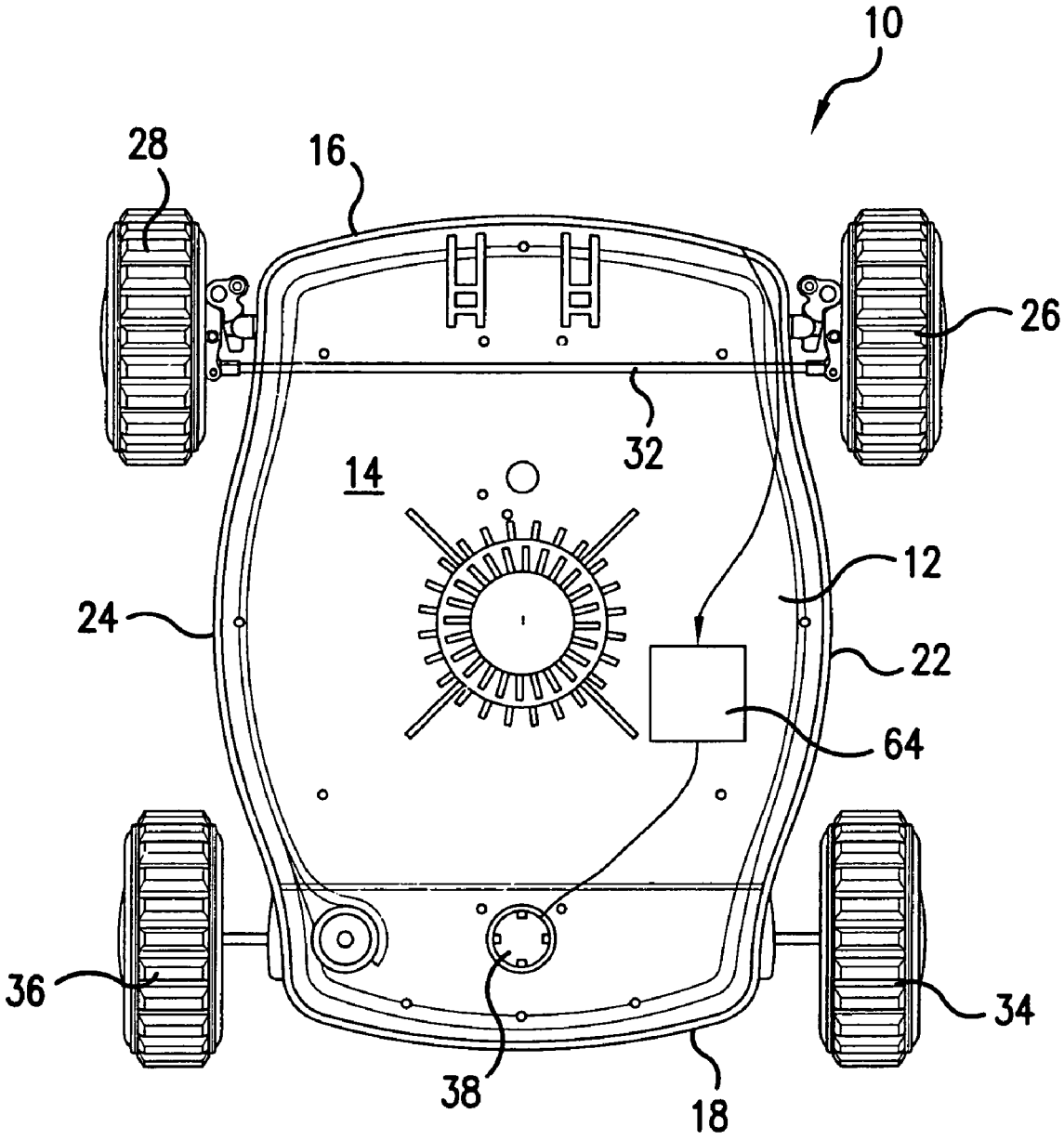
FIG. 1 is a bottom plan view illustrating the front wheel mounting mechanism for a pool cleaner according to the present invention.
Figure 2:
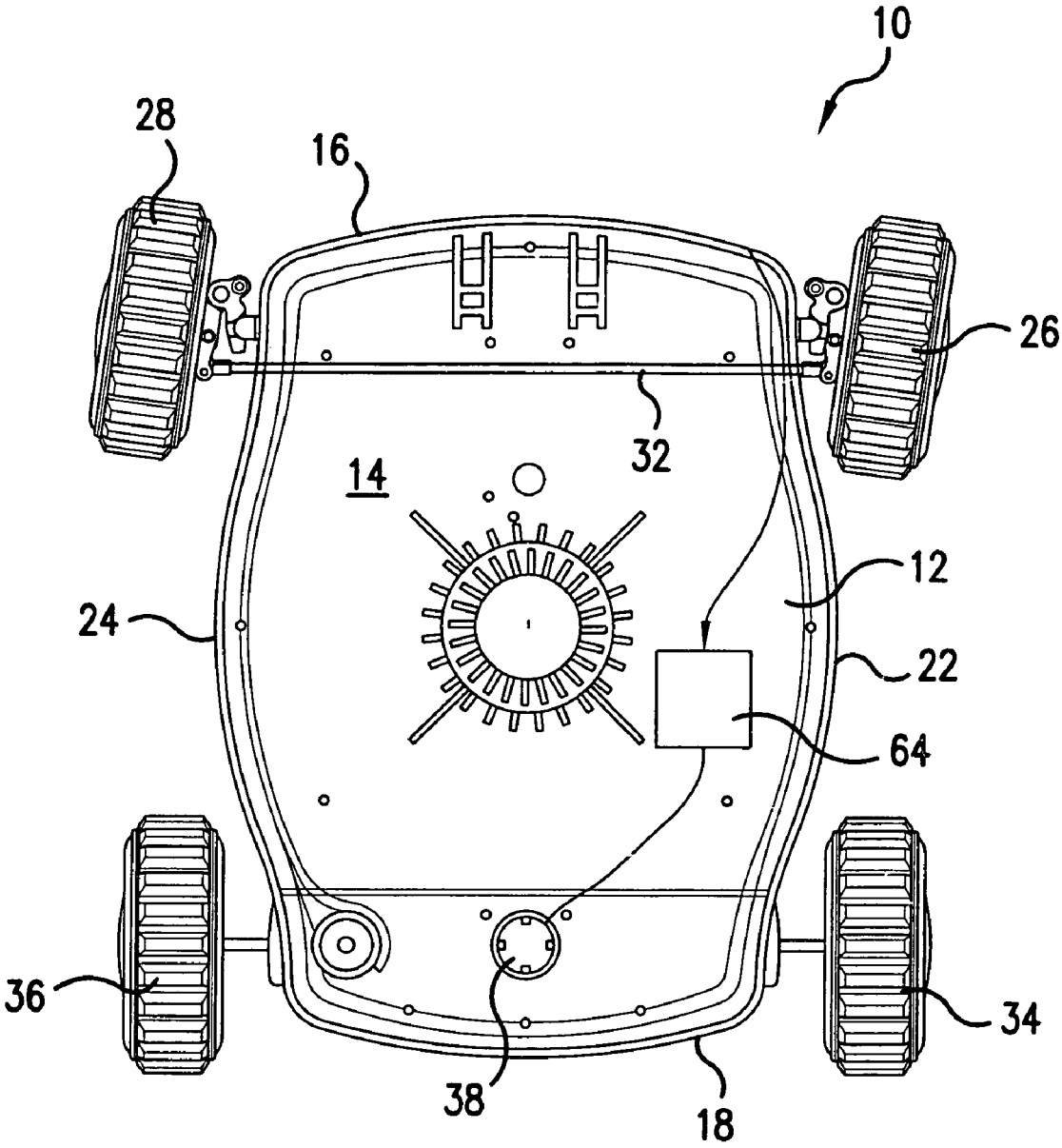
FIG. 2 is a bottom plan view similar to FIG. 1 wherein the front wheels are arranged at an angle relative to the housing for the pool cleaner.

As illustrated in FIGS. 1 and 2, a pool cleaner 10 is provided for cleaning a swimming pool that includes a housing 12 with an upper surface 14 and downwardly projecting sidewalls extending downwardly from the upper surface 14 for defining a front end 16, a rear end 18, a first side 22 and a second side 24 of the housing 12.

A first pair of wheels are mounted relative to the front end 16 of the housing, the first pair of wheels includes a first wheel 26 being pivotally mounted relative to the first side 22 of the housing 12 and a second wheel 28 that is pivotally mounted relative to the second side 24 of the housing 12. A tie rod 32 is operatively mounted relative to the first wheel 26 and the second wheel 28 for ensuring substantially the same angular relationship of the first wheel 26 and the second wheel 28 relative to the housing 12. A second pair of wheels 34, 36 are mounted relative to the rear end 18 of the housing 12. The second pair of wheels 34, 36 are connected to a drive mechanism 38 for providing rotary motion to the wheels 34, 36 for propelling the pool cleaner 10 relative to a surface of a swimming pool.

As the pool cleaner 10 traverses a pool surface and the first wheel 26 engages a wall surface to be moved to be at a predetermined angular relationship relative to the housing 12, the tie rod 32 imparts movement to the second wheel 28 for ensuring that the first wheel 26 and the second wheel 28 are at substantially the same angular relationship relative to the housing. As illustrated in FIG. 1, the first wheel 26 and the second wheel 28 are arranged to be substantially in a longitudinal direction relative to the pool cleaner 10 for enabling the pool cleaner to move in substantially a straight path.

As illustrated in FIG. 2, the first wheel 26 and the second wheel 28 are arranged to be at an angular relationship relative to the housing 12 for enabling the pool cleaner to move in a trajectory that is at an angle relative to the previous trajectory of the pool cleaner 10. The pool cleaner 10 is designed to move completely randomly relative to a surface of a swimming pool to ensure that the entire swimming pool is cleaned.

The first wheel 26 and the second wheel 28 projected outwardly relative to the front end 16 of the housing 12 for enabling either the first wheel 26 or the second wheel 28 to engage a wall surface of a pool for imparting a turning motion to the first wheel 26 or the second wheel 28 for changing the angular relationship of the wheels 26, 28 relative to the housing 12. The tie rod 32 is designed to move the first wheel 26 and the second wheel 28 in a controlled tandem relationship for maintaining the angular relationship of the wheels 26, 28 relative to the housing 12.

A reversible drive mechanism 38 is provided for imparting rotation to the second pair of wheels 34, 36 for enabling the pool cleaner 10 to traverse a pool surface and for changing the trajectory of the pool cleaner when the first wheel 26 and second wheel 28 are moved to a predetermined angular relationship relative to the housing 12.

Figure 3:
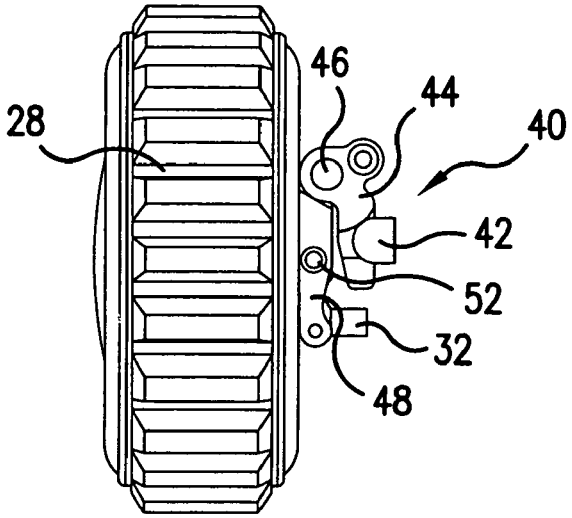
FIG. 3 is an elevational view of a front wheel with a pin for holding the front wheel relative to the housing and a tie rod connecting member.
Figure 4:
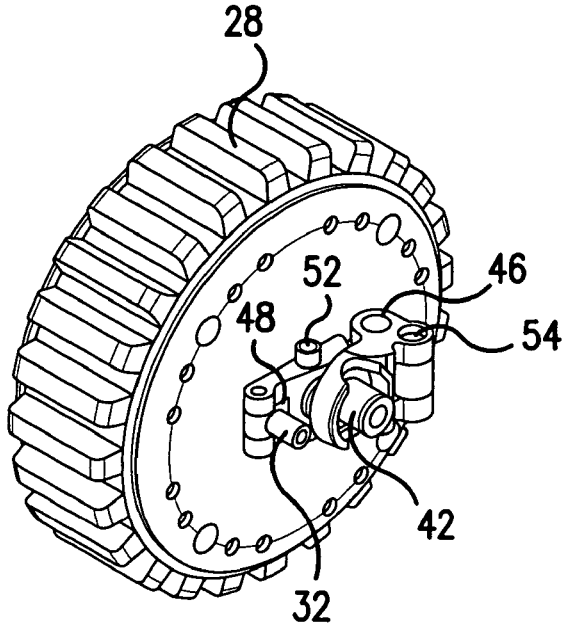
FIG. 4 is a perspective view of a front wheel similar to FIG. 3.
Figure 5:
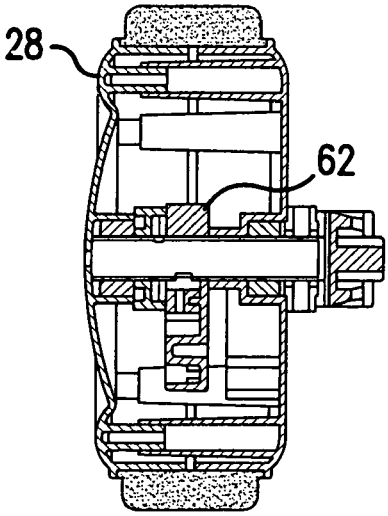
FIG. 5 is a cross-sectional view of front wheel with a reed switch connected thereto.

FIGS. 3-5 are enlarged views of the second wheel 28 and the mounting mechanism 40 for securing the second wheel 28 to the second side 24 of the housing 12. The mounting mechanism 40 includes a support 42 for securing the mounting mechanism 40 relative to the housing 12. A first arm 44 extends from the support 42. A second arm 48 is hinged at a proximal end to the first arm 44 by means of a pin 46. The tie rod 32 is connected to a distal end of the second arm 48 for ensuring that the first wheel 26 and the second wheel 28 are disposed at substantially the same angular relationship relative to the housing 12. The second wheel 28 is mounted relative to the mounting mechanism 40 at a point adjacent to the member 52. A second pivot connection 54 is provided on the first arm 44. If no pin is positioned within the second pivot connection 54, a larger angle of swing is permitted for the second wheel 28. If a pin is engaged within the second pivot connection 54, the second wheel 28 is limited in the angle of swing. A larger angle of swing is desirable for an unusually shaped pool and/or a pool with obstructions to ensure complete coverage for the pool cleaner 10 for cleaning the swimming pool. The construction of the mounting mechanism for the first wheel is the same as the mounting mechanism 40 for the second wheel 28. Thus, a description of the mounting mechanism for the first wheel will not be provided.

A motion sensor 62 is positioned within the second wheel 28 for detecting if the second wheel 28 engages a wall surface for actuating a control mechanism 64 for reversing the drive mechanism 38 for reversing the direction of the pool cleaner 10. The motion sensor 62 may be a reed switch with a magnet for directly measuring the wheel motion. In addition, a similar motion sensor is positioned within the first wheel 26 for actuating the control mechanism 64 for reversing the drive mechanism 38 for reversing the direction of the pool cleaner 10. Other types of motion sensors such as a proximity switch are within the scope of the present invention. A hollow axle is employed to permit a sensor wire to run through the axle without affecting wheel rotation and for providing an accurate and direct wheel rotation measurement.

The control mechanism 64 includes a first random timing logic for delaying the reversing of the drive mechanism 38 after either the first wheel 26 or the second wheel 28 engages a wall surface of a pool. In addition, the control mechanism 64 includes a second random timing logic for periodic reversing of the drive mechanism randomly throughout a cleaning cycle of a pool.

Figure 6:
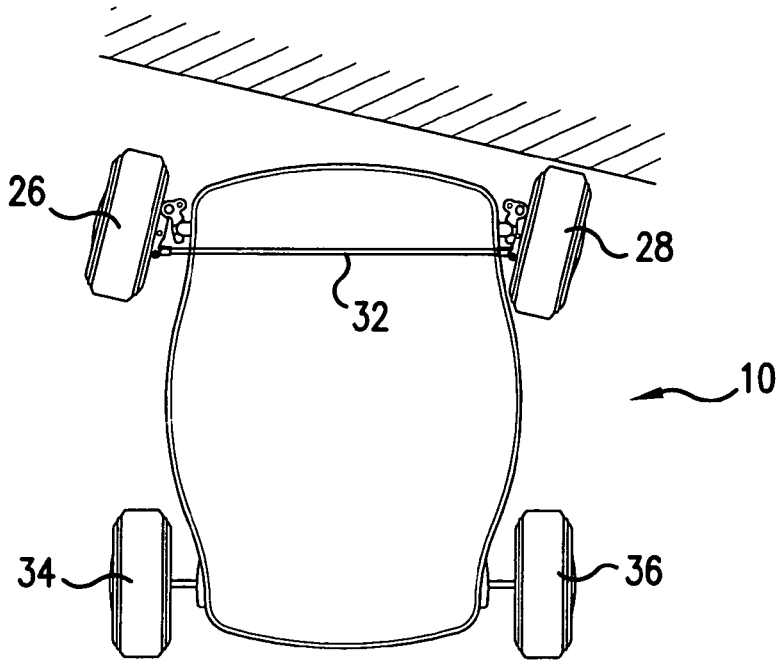
FIG. 6 is a schematic view illustrating the front wheels being turned by the tie rod to a first angular relationship relative to the housing.
Figure 7:
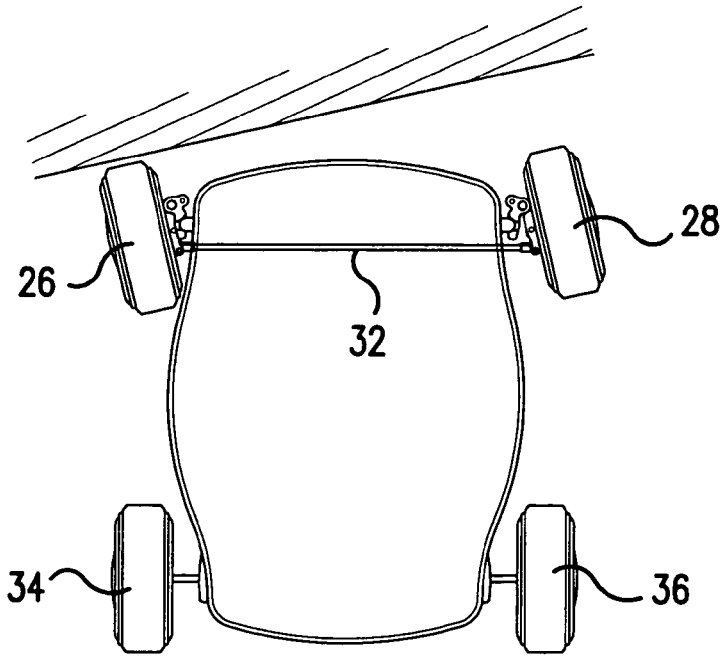
FIG. 7 is a schematic view illustrating the front wheels being turned by the tie rod to a second angular relationship relative to the housing.

FIGS. 6 and 7 illustrate schematic views of the pool cleaner 10 wherein the first wheel 26 and the second wheel 28 are tied together by the tie rod 32 to ensure that the first wheel 26 and the second wheel 28 are moved in the same direction. As illustrated in FIG. 6, if the second wheel 28 hits a wall of the swimming pool, the pool cleaner 10 tends to move to the right. Similarly, as illustrated in FIG. 7, if the first wheel 26 hits the wall of the swimming pool, the pool cleaner 10 tends to move to the left. The tie rod 32 ensures that both the first wheel 26 and the second wheel 28 are moved in the same direction to be at substantially the same lateral angular relationship relative to the housing 12.

By incorporating the first random timing logic for controlling the time delay between the pool cleaner 10 hitting a wall surface before the pool cleaner 10 reverses, the reverse path is more unpredictable. If the delay timing is long enough to allow the unit to keep pushing against the wall to the extent that the whole unit pivots about the point of the wheel and the wall contact, the whole unit rotates about the point of contact. When the pool cleaner 10 reverses, the pool cleaner 10 will be at a random trajectory as compared to the previous trajectory. A longer push to rotate before the reversal of the drive mechanism results in a more dramatic turn between the forward path and the reverse path. A shorter push to rotate before the reversal of the drive mechanism results in a less dramatic turn between the forward path and the reverse path.

The second random timing logic is provided in the control mechanism 64 for periodically reversing the direction of the cleaner while it is traversing a surface of the pool. The combination of the first random timing logic and the second random timing logic patterns assures unpredictability in the movement of the pool cleaner 10 for providing the best coverage of the pool surface.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pool cleaner for cleaning a pool comprising:

a housing for the pool cleaner including an upper surface and downwardly projecting sidewalls extending downwardly from the upper surface for defining a front end, a rear end, a first side and a second side of said housing;

a first mounting mechanism including a first arm and a second arm mounted on the first side relative to the front end of said housing for the pool cleaner;

a first wheel being mounted on said second arm of said first mounting mechanism for independent pivotal movement relative to the first side of the housing;

a second mounting mechanism including a first arm and a second arm mounted on the second side relative to the front end of said housing for the pool cleaner;

a second wheel being mounted on said second arm of said second mounting mechanism for independent pivotal movement relative to the second side of said housing;

a tie rod operatively mounted relative to the second arm of the first mounting mechanism and the second arm of the second mounting mechanism for ensuring substantially the same angular relationship of the first wheel and the second wheel relative to said housing; and a second pair of wheels mounted relative to the rear end of said housing;

wherein when the pool cleaner traverses a pool surface and either the first wheel or the second wheel is moved to be at a lateral angular relationship relative to the housing, the tie rod imparts movement to the second wheel for ensuring that the first and second wheels are at substantially the same angular relationship relative to said housing;

wherein the first and second wheels project outwardly relative to the front end of said housing for enabling either the first or second wheels to engage a wall surface of a pool for imparting a turning motion to the first wheel or the second wheel for changing an angular relationship of the wheels relative to said housing.

2. The pool cleaner for cleaning a pool according to claim 1, and further including a reversible drive mechanism for imparting rotation to said second pair of wheels for enabling the pool cleaner to traverse a pool surface and for changing the trajectory of the pool cleaner when the first and second pair of wheels are moved to a lateral angular relationship relative to said housing.

3. The pool cleaner for cleaning a pool according to claim 2, and further including a first random timing logic for varying the delay before the reversing of the drive mechanism after either the first wheel or the second wheel engages a wall surface of a pool.

4. The pool cleaner for cleaning a pool according to claim 2, and further including a second random timing logic for periodically reversing the drive mechanism randomly throughout a cleaning cycle of a pool.

5. The pool cleaner for cleaning a pool according to claim 1, and further including a motion sensor positioned within said first wheel for detecting if the first wheel engages a wall surface for actuating a control mechanism for reversing a drive mechanism for reversing the direction of the pool cleaner.

6. The pool cleaner for cleaning a pool according to claim 5, wherein the motion sensor is a reed switch.

7. The pool cleaner for cleaning a pool according to claim 1, and further including a motion sensor positioned within said second wheel for detecting if the second wheel engages a wall surface for actuating a control mechanism for reversing a drive mechanism for reversing the direction of the pool cleaner.

8. The pool cleaner for cleaning a pool according to claim 7, wherein the motion sensor is a reed switch.

9. The pool cleaner for cleaning a pool according to claim 1, wherein the first mounting mechanism includes:

a support secured relative to the first side of the housing;

the first arm on the first side including a distal end and a proximal end, said proximal end of the first arm being secured relative to the support;

the second arm on the first side including a distal end and a proximal end, said proximal end of the first side second arm being pivotally mounted relative to the distal end of the first arm;

said tie rod being operatively mounted relative to the distal end of the first side second arm of the first mounting mechanism;

the second mounting mechanism includes:

a support secured relative to the second side of the housing;

the first arm on the second side including a distal end and a proximal end, said proximal end of the first arm being secured relative to the support;

the second arm on the second side including a distal end and a proximal end, said proximal end of the second side second arm being pivotally mounted relative to the distal end of the first arm;

said tie rod being operatively mounted relative to the distal end of the second side second arm of the second mounting mechanism for ensuring substantially the same angular relationship of the first wheel and the second wheel relative to the housing.

10. The pool cleaner for cleaning a pool according to claim 1, wherein the first wheel is mounted along a length of the first side second arm and the second wheel is mounted along a length of the second side second arm.

11. A pool cleaner for cleaning a pool comprising:

a housing for the pool cleaner including an upper surface and sidewalls extending from the upper surface for defining a front end, a rear end, a first side and a second side of said housing;

a first mounting mechanism including a first arm and a second arm mounted on the first side relative to the front end of said housing for the pool cleaner;

a first wheel being mounted on the second arm of the first mounting mechanism for independent pivotal movement relative to the first side of the housing;

a second mounting mechanism including a first arm and a second arm mounted on the second side relative to the front end of said housing for the pool cleaner;

a second wheel being mounted on the second arm of the second mounting mechanism for independent pivotal movement relative to the second side of said housing;

a tie rod operatively positioned relative to the second arm of the first mounting mechanism and the second arm of the second mounting mechanism for ensuring substantially the same angular relationship of the first wheel and the second wheel relative to said housing; and a second pair of wheels mounted relative to the rear end of said housing;

wherein when either the first wheel or the second wheel is moved to be at a lateral angular relationship relative to the housing, the tie rod imparts movement to the second wheel or the first wheel for ensuring that the first and second wheels are at substantially the same angular relationship relative to said housing;

wherein the first and second wheels project outwardly relative to the front end of said housing for enabling either the first or second wheels to engage a wall surface of a pool for imparting a turning motion to the first wheel or the second wheel for changing the angular relationship of the wheels relative to said housing.

12. The pool cleaner for cleaning a pool according to claim 11, and further including a reversible drive mechanism for imparting rotation to said second pair of wheels for enabling the pool cleaner to traverse a pool surface and for changing the trajectory of the pool cleaner when the first and second pair of wheels are moved to a lateral angular relationship relative to said housing.

13. The pool cleaner for cleaning a pool according to claim 12, and further including a first random timing logic for varying the delay before the reversing of the drive mechanism after either the first wheel or the second wheel engages a wall surface of a pool.

14. The pool cleaner for cleaning a pool according to claim 12, and further including a second random timing logic for periodically reversing the drive mechanism randomly throughout a cleaning cycle of a pool.

15. The pool cleaner for cleaning a pool according to claim 11, and further including a motion sensor positioned within said first wheel for detecting if the first wheel engages a wall surface for actuating a control mechanism for reversing a drive mechanism for reversing the direction of the pool cleaner.

16. The pool cleaner for cleaning a pool according to claim 15, wherein the motion sensor is a reed switch.

17. The pool cleaner for cleaning a pool according to claim 11, and further including a motion sensor positioned within said second wheel for detecting if the second wheel engages a wall surface for actuating a control mechanism for reversing a drive mechanism for reversing the direction of the pool cleaner.

18. The pool cleaner for cleaning a pool according to claim 17, wherein the motion sensor is a reed switch.

* * * * *